US005613548A

United States Patent [19]

Streubel et al.

[11] Patent Number: 5,613,548

[45] Date of Patent: Mar. 25, 1997

[54] CONTINUOUS CASTING PLANT FOR CASTING THIN SLABS

[75] Inventors: Hans Streubel; Günter Flemming, both of Erkrath; Erk Boysen, Ratingen, all of Germany

[73] Assignee: SMS Schloemann-Siemag Aktiengesellschaft, Düsseldorf, Germany

[21] Appl. No.: 517,881

[22] Filed: Aug. 22, 1995

[30] Foreign Application Priority Data

Aug. 22, 1994 [DE] Germany ..... 44 29 685.1

[51] Int. Cl.[6] ..... B22D 27/02

[52] U.S. Cl. ..... 164/502; 164/466

[58] Field of Search ..... 164/502, 503, 164/504, 466, 467, 468, 498, 499, 500, 147.1

[56] References Cited

FOREIGN PATENT DOCUMENTS

92/12814 8/1992 WIPO .

*Primary Examiner*—Kuang Y. Lin
*Attorney, Agent, or Firm*—Friedrich Kueffner

[57] ABSTRACT

A continuous casting plant for casting thin slabs includes an electromagnetic decelerating unit for the molten steel which flows into the mold through a submerged casting pipe. The electromagnetic decelerating unit is composed of a coil with a ferromagnetic core arranged on each of the long sides of the mold and a yoke surrounding the mold. The cores on the long sides of the mold each are composed of a principal core and a partial core on the side of the cast strand, wherein different partial cores can be used as desired for adapting the magnetic field to changing casting conditions.

6 Claims, 3 Drawing Sheets

CONTINUOUS CASTING PLANT FOR CASTING THIN SLABS

BACKGROUND OF THE INVENTION

1. Field of the Invention

The present invention relates to a continuous casting plant for casting thin slabs. The continuous casting plant includes an electromagnetic decelerating unit for the molten steel which flows into the mold through a submerged casting pipe. The electromagnetic decelerating unit is composed of a coil with a ferromagnetic core arranged on each of the long sides of the mold and a yoke surrounding the mold.

2. Description of the Related Art

In a continuous casting plant of this type disclosed in EP-B1 04 01 504, cores of an electromagnetic decelerating unit are provided at the long sides of a slab mold, wherein the poles of the cores are arranged one above the other. The cores can be pivoted about a lower axis in order to influence the flux density of the magnetic field. This complicated arrangement makes it possible to influence the magnetic field only to a limited extent and with insufficient accuracy.

The present invention is based on the finding that different casting schedules, i.e., different casting speeds, casting dimensions, steel qualities and casting conditions, result in different instable flow conditions within the mold and, thus, in deficiencies of the quality of the cast product.

SUMMARY OF THE INVENTION

Therefore, it is the primary object of the present invention to provide a continuous casting plant with a narrow mold space for casting thin slabs, in which a simple and inexpensive decelerating unit makes it possible to adjust the molten steel flowing from the submerged casting pipe at high speeds more accurately to the casting schedule and the resulting casting conditions.

In accordance with the present invention, the cores on the long sides of the mold each are composed of a principal core and a partial core on the side of the cast strand, wherein different partial cores can be used as desired for adapting the magnetic field to changing casting conditions.

By adjusting the magnetic fields to the respective casting schedule in accordance with the present invention, it is possible in the case of changing casting conditions to achieve a constant optimum flow distribution within the mold by effecting a defined deceleration of the casting speed. In particular, the present invention makes it possible to prevent washing-out of the strand shell, waves in the casting level, local thickness variations of the slag layer on the casting level which results in deficient lubrication, and a drawing-in of slag and casting powder into the strand. This results as the overall effect in a significant improvement of the strand surface as well as of the structure of the cast thin slab.

In order to achieve a more accurate adaptation and adjustment of the magnetic field, partial cores having the following configurations can be used:

The partial cores have different lengths.

The partial cores have different heights.

The partial cores have portions of reduced cross-section.

Side portions of a partial core are offset with respect to height relative to a middle portion.

In accordance with another feature of the present invention, a mold frame has a recess for receiving the different partial cores of magnetic material, wherein the recess is arranged on the side of the casting strand in front of the principal core. Non-magnetic filler pieces are placed into any empty spaces remaining in the recess after partial cores of different dimensions have been placed in the recess.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
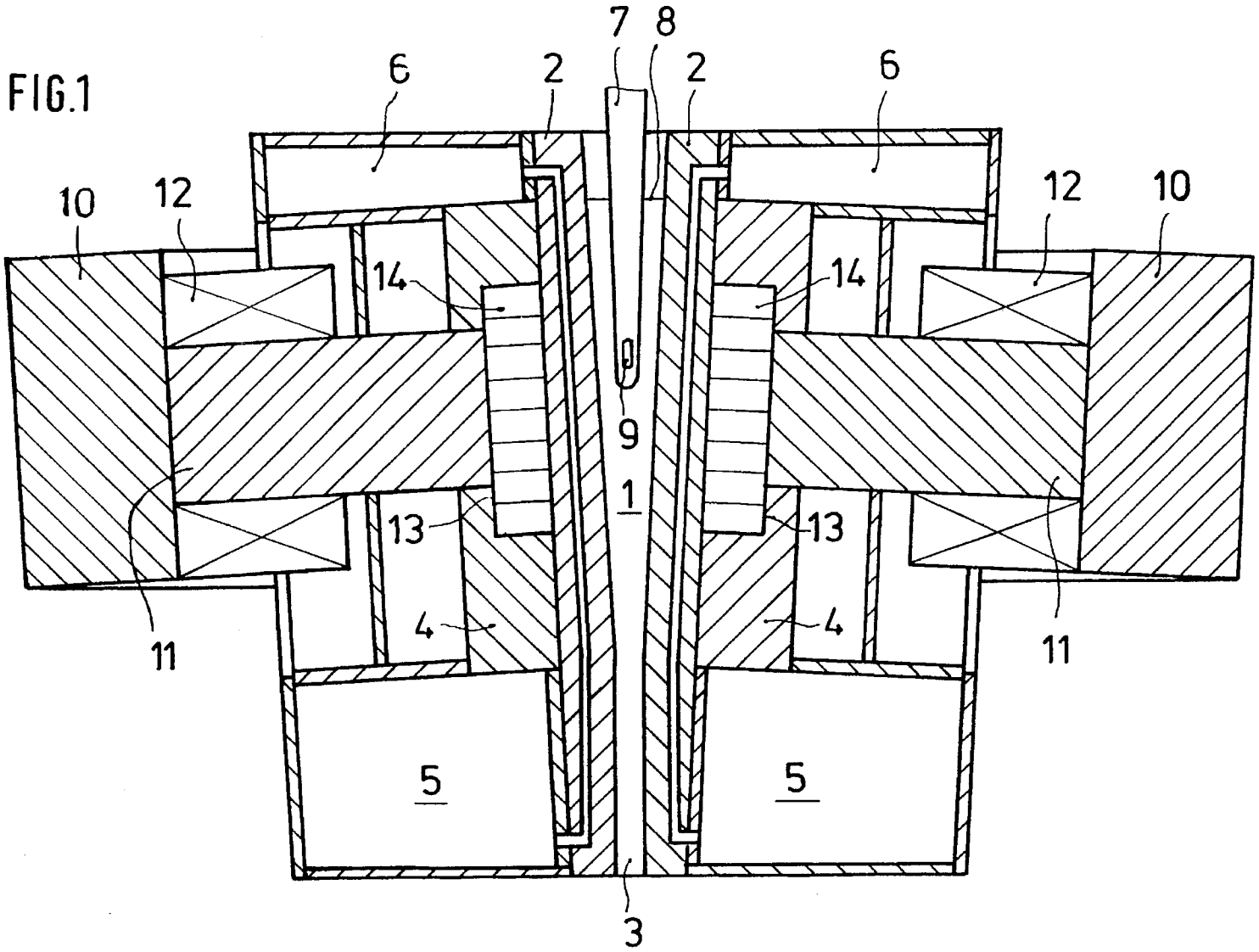
FIG. 1 is a cross-sectional view of a continuous casting mold for thin slabs with an electromagnetic decelerating unit.

In the continuous casting mold for thin slabs illustrated in FIG. 1, a mold space 1 is formed by two cooled long side walls 2 and by narrow side walls 3. The long side walls 2 are fastened to a mold frame 4.

The supply of cooling water is effected from a lower cooling chamber 5 on each side of the mold, while the cooling water discharge is effected through an upper cooling chamber 6 on each side of the mold.

The molten steel is conducted into the mold through a submerged casting pipe 7 and the mold is filled up to the casting level 8 which is covered by casting powder. The submerged casting pipe 7 is provided with downwardly inclined lateral openings 9 from which the casting flows emerge.

An electromagnetic decelerating unit for the emerging casting flows is composed of a yoke it 10 which surrounds the mold. A principal core 11 extending over the width of the mold is attached on each side. Each principal core 11 is surrounded by a coil 12. Recesses 13 are provided in the mold frame 4 at the end faces of the principal cores. Partial cores 14*a–m* for influencing the magnetic field are optionally placed in the recesses 13.

Figure 2:
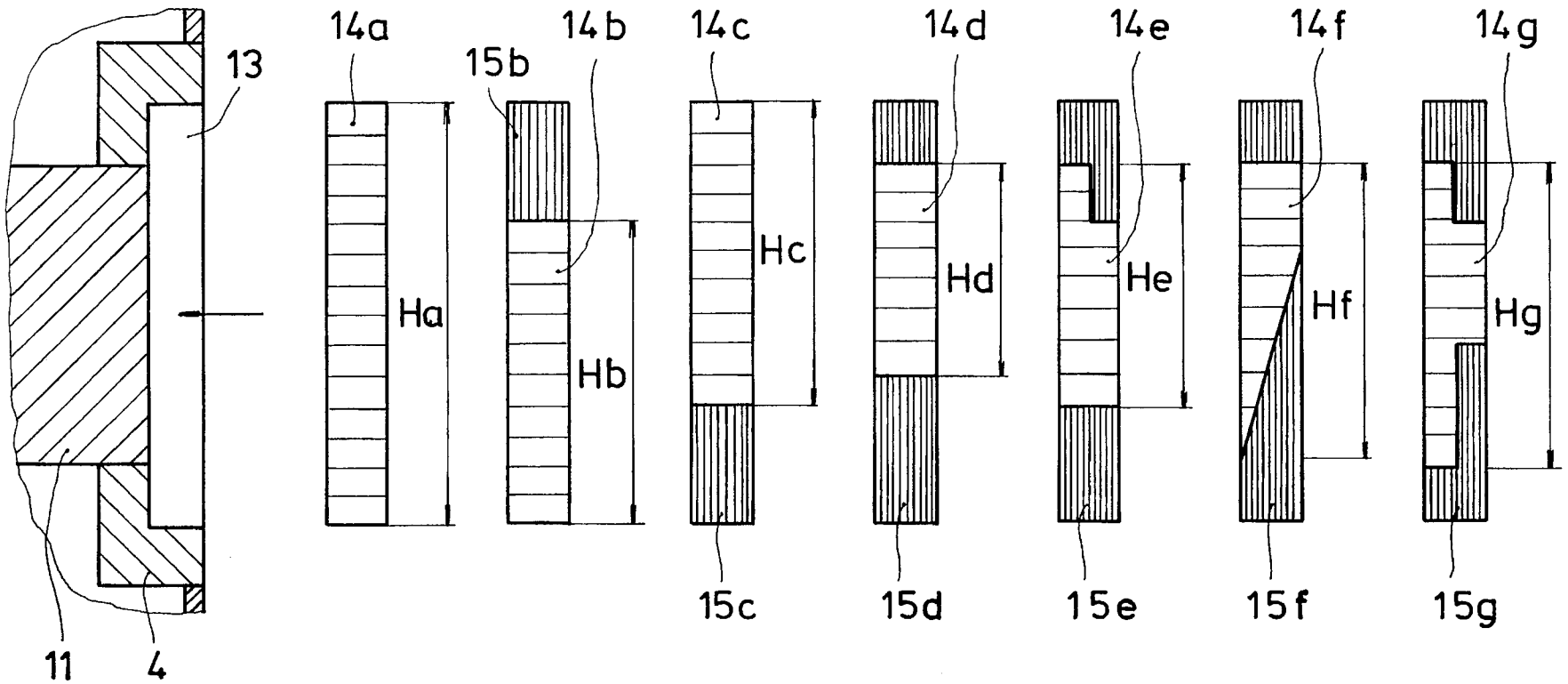
FIG. 2 shows a vertical partial sectional view of the mold frame in the area of the recess for a partial core with cross-sectional views of different partial cores.

FIG. 2 shows various partial cores 14*a–g*. The partial cores 14*a–g* differ from each other with respect to length, cross-sectional shape as well as with respect to their arrangement within the recess 13. Any empty spaces are filled out by non-magnetic filler pieces 15*b–g*.

Figures 3, 4:
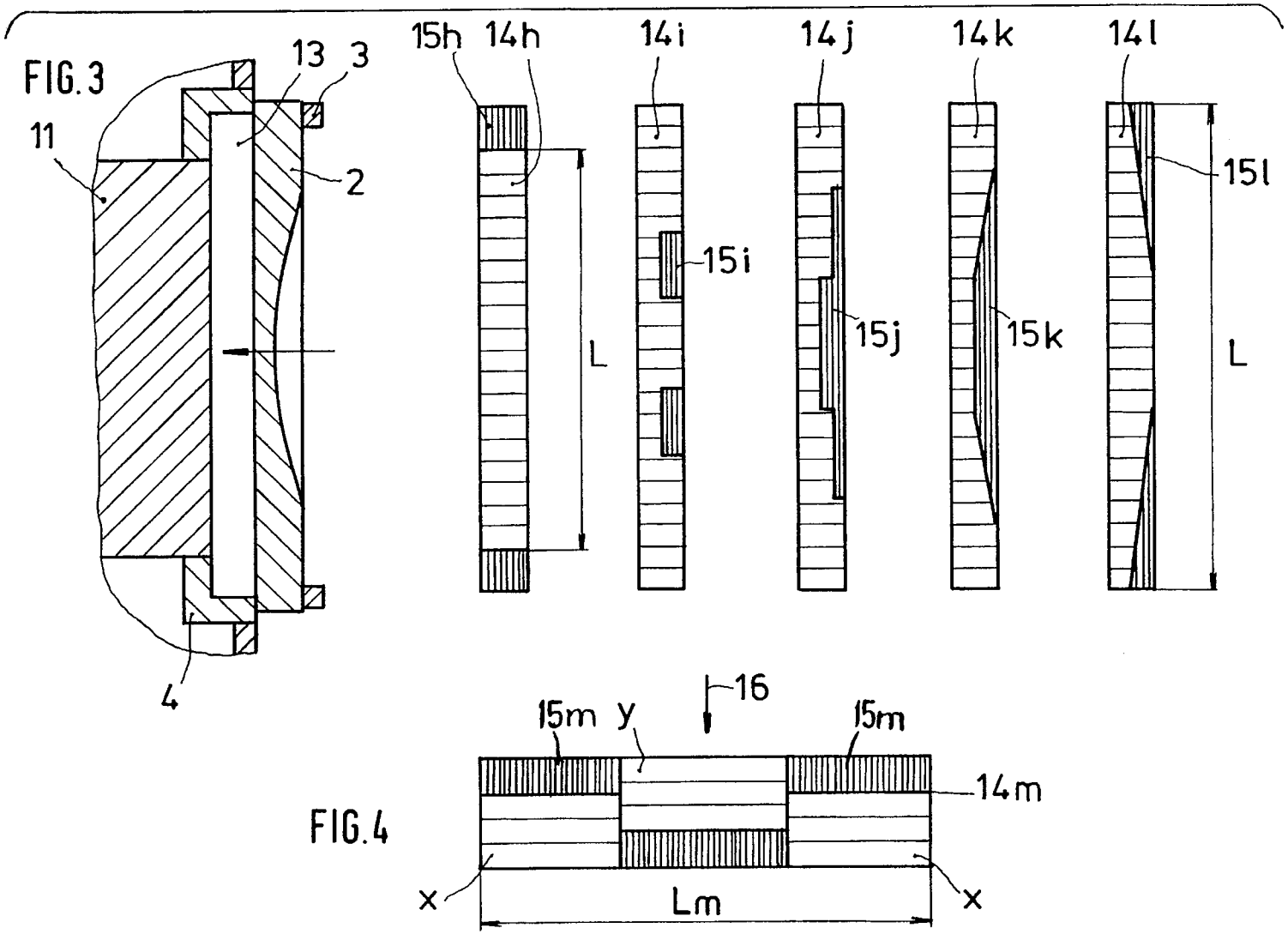
FIG. 3 is a horizontal partial cross-sectional view of a mold side with longitudinal sectional views of different partial cores.
FIG. 4 is an elevational view of a partial core with side portions which are offset in casting direction relative to a middle portion.

FIG. 3 shows longitudinal views of partial cores 14*h–l* extending over the width of the mold in front of a recess 13 in the mold frame 4 shown in horizontal section. For influencing the magnetic field, the partial cores 14*h–l* have longitudinal portions of reduced cross-section, wherein hollow spaces are filled out by filler pieces 15*i–l* of non-magnetic material. The lengths of the partial cores may also vary.

FIG. 4 shows a front view of a partial core 14*m*. The partial core 14*m* is divided into side portions X and a middle portion Y, wherein the side portions X are offset relative to the middle portion Y in the casting direction indicated by arrow 16. In this manner, an adaptation in the direction of downwardly inclined casting flows is effected. The spaces between the portions X and Y of the partial core 14*m* are filled by filler pieces 15*m*.

The present invention is not limited to the illustrated embodiment of a thin slab mold with a funnel-shaped upper casting area; rather, the present invention can also be used in molds having long side walls which extend parallel to each other or which are arched from the top toward the outlet opening of the mold.

While specific embodiments of the invention have been shown and described in detail to illustrate the inventive principles, it will be understood that the invention may be embodied otherwise without departing from such principles.

We claim:

1. A continuous casting plant for casting thin slabs, the continuous casting plant comprising a mold having long sides and narrow sides, the long sides and narrow sides defining a mold space, a casting pipe extending into the mold space, an electromagnetic decelerating unit for producing a magnetic field for decelerating molten steel which flows into the mold space through the casting pipe, the electromagnetic decelerating unit comprising a coil with a ferromagnetic core arranged on each of the long sides of the mold and a yoke surrounding the mold, the core comprising a principal core and partial cores facing the mold space, wherein the partial cores are arranged immediately adjacent the long sides of the mold and are exchangeable for adapting the magnetic field to changing casting conditions.

2. The continuous casting plant according to claim 1, wherein the exchangeable partial cores have different lengths.

3. The continuous casting plant according to claim 1, wherein the exchangeable partial cores have different heights.

4. The continuous casting plant according to claim 1, wherein the exchangeable partial cores have lengths, and wherein the partial cores have portions of reduced cross-section over the lengths thereof.

5. The continuous casting plant according to claim 1, wherein an exchangeable partial core has a length and a height, the partial core having a middle portion and side portions adjacent the side portion side portions, wherein the middle portion is arranged offset relative to the side portions in a casting direction.

6. The continuous casting plant according to claim 1, wherein the mold further comprises a mold frame, the mold frame having recesses for receiving the exchangeable partial cores, the recesses being arranged on the long sides of the mold and facing the mold space, further comprising non-magnetic filler pieces for placement in spaces of the recesses not occupied by partial cores.

* * * * *